US009583040B2

(12) United States Patent
Yamashita et al.

(10) Patent No.: US 9,583,040 B2
(45) Date of Patent: Feb. 28, 2017

(54) DISPLAY DEVICE AND DISPLAY DRIVE METHOD

(75) Inventors: Junichi Yamashita, Tokyo (JP); Katsuhide Uchino, Kanagawa (JP)

(73) Assignee: JOLED Inc., Tokyo (JP)

( * ) Notice: Subject to any disclaimer, the term of this patent is extended or adjusted under 35 U.S.C. 154(b) by 852 days.

(21) Appl. No.: 12/461,132

(22) Filed: Aug. 3, 2009

(65) Prior Publication Data

US 2010/0045652 A1 Feb. 25, 2010

(30) Foreign Application Priority Data

Aug. 19, 2008 (JP) ..... 2008-210509

(51) Int. Cl.
*G09G 3/30* (2006.01)
*G09G 3/32* (2016.01)

(52) U.S. Cl.
CPC ... *G09G 3/3233* (2013.01); *G09G 2300/0819* (2013.01); *G09G 2300/0866* (2013.01); *G09G 2310/06* (2013.01)

(58) Field of Classification Search
CPC ..... G09G 3/3233
USPC ..... 345/76–78, 80, 82, 83; 315/169.3
See application file for complete search history.

(56) References Cited

U.S. PATENT DOCUMENTS 7,102,202 B2 9/2006 Kobayashi et al.
7,876,294 B2 * 1/2011 Sasaki et al. ..... 345/77
2004/0046164 A1 * 3/2004 Kobayashi et al. ..... 257/13
2005/0206590 A1 9/2005 Sasaki et al.
2006/0267884 A1 * 11/2006 Takahashi et al. ..... 345/76
2008/0030436 A1 * 2/2008 Iida et al. ..... 345/77
2008/0150843 A1 * 6/2008 Yamamoto et al. ..... 345/76
2009/0251493 A1 * 10/2009 Uchino et al. ..... 345/690

FOREIGN PATENT DOCUMENTS

JP 2003-271095 9/2003
JP 2005-258326 A 9/2005
JP 2006-330223 A 12/2006
(Continued)

OTHER PUBLICATIONS

Japanese Office Action issued May 6, 2010 for corresponding Japanese Application No. 2008-210509.

*Primary Examiner* — Jeff Piziali
(74) *Attorney, Agent, or Firm* — Michael Best & Friedrich LLP

(57) ABSTRACT

A display device includes: a pixel array including pixel circuits arranged in a matrix, each pixel circuit having a light emitting element, a drive transistor, and a storage capacitor storing a threshold voltage of the transistor and an inputted signal value; and a threshold correction operation means for performing a threshold correction operation plural times, which allows the storage capacitor to store the threshold voltage by applying a drive voltage to the transistor in a state where a gate potential of the transistor is fixed in a reference potential before giving the signal value to the storage capacitor. The threshold correction operation is started in a state where the gate potential is made a correction acceleration potential higher than the reference potential only at the threshold correction operation of the first half in the plural threshold correction operations, then, returns the gate potential to the reference potential to be fixed.

10 Claims, 6 Drawing Sheets

(56) References Cited

FOREIGN PATENT DOCUMENTS

| | | | |
|---|---|---|---|
| JP | 2007-133282 | | 5/2007 |
| JP | 2007-255856 | | 10/2007 |
| JP | 2008-033193 | A | 2/2008 |
| WO | WO 2007055376 | A1 * | 5/2007 |

* cited by examiner

DISPLAY DEVICE AND DISPLAY DRIVE METHOD

BACKGROUND OF THE INVENTION

1. Field of the Invention

The invention relates to a display device including a pixel array in which pixel circuits are arranged in a matrix state and a display drive method thereof, and relates to, for example, a display device using an organic electroluminescence element (organic EL element) as a light emitting element.

2. Description of the Related Art

An image display device in which an organic EL element is used in a pixel is developed, for example as shown in JP-2003-255856 and JP-2003-271095 (Patent Documents 2 and 3). Since the organic EL element is a self-luminous element, it has advantages such that visibility of images is higher than, for example, a liquid crystal display, a backlight is not necessary and response speed is high. The luminance level (tone) of each light emitting element can be controlled by a value of current flowing therein (so-called current-control type).

The organic EL display has a passive matrix type and an active matrix type as a drive method in the same manner as the liquid crystal display. The former has problems such that it is difficult to realize a large-sized as well as high-definition display though it has a simple configuration, therefore, the active-matrix type display device is vigorously developed at present. The display device of this type controls electric current flowing in the light emitting element in each pixel circuit by an active element (commonly, a thin film transistor: TFT) provided inside the pixel circuit.

SUMMARY OF THE INVENTION

As the pixel circuit configuration using the organic EL element, improvement of display quality as well as realization of high luminance, high definition and a high frame rate (high frequency) by eliminating luminance unevenness in each pixel and the like are strongly requested.

From the above viewpoint, various configurations are considered. For example, pixel circuit configurations and operations are variously proposed, in which luminance unevenness in each pixel can be eliminated by cancelling variation of a threshold voltage or mobility of a drive transistor in each pixel as in JP-2007-133282 (Patent Document 1).

It is desirable to realize a more suitable threshold cancel operation as the display device using the organic EL element, and particularly, to speed up the threshold cancel operation so as to respond to a higher frequency in the pixel circuit operation.

According to an embodiment of the invention, there is provided a display device including a pixel array having pixel circuits arranged in a matrix state, in which each pixel circuit has at least a light emitting element, a drive transistor applying electric current to the light emitting element in accordance with a signal potential given between a gate and a source by a drive voltage applied between the drain and the source, and a storage capacitor connected between the gate and the source of the drive transistor and storing a threshold voltage of the drive transistor and the inputted signal value, and a threshold correction operation means for performing a threshold correction operation plural times, which allows the storage capacitor to store the threshold voltage of the drive transistor by applying a drive voltage to the drive transistor in a state in which a gate potential of the drive transistor is fixed in a reference potential before giving the signal value to the storage capacitor. The threshold correction operation means starts the threshold correction operation in a state in which the gate potential is made to be a correction acceleration potential which is higher than the reference potential only at the time of the threshold correction operation of the first half in the threshold correction operations of plural number of times, then, returns the gate potential to the reference potential to be fixed.

The threshold correction operation means starts the threshold correction operation in a state in which the gate potential is made to be a given potential which is higher than the reference potential only at the time of the first threshold correction operation as the threshold correction operation of the first half in the threshold correction operations of plural number of times, then, returns the gate potential to the reference potential to be fixed.

The display device also includes a signal selector supplying respective potentials as the signal potential, the reference potential and the correction acceleration potential to respective signal lines arranged in columns on the pixel array, a write scanner introducing potentials of the signal lines into the pixel circuits by driving respective write control lines arranged in rows on the pixel array and a drive control scanner applying the drive voltage to the drive transistors in the pixel circuits by using respective power control lines arranged in rows on the pixel array. The threshold correction operation means is realized by an operation of making the gate potential of the drive transistor be the reference potential and the correction acceleration potential given from the signal line by the write scanner and an operation of supplying the drive voltage to the drive transistor by the drive control scanner.

The pixel circuit further includes a sampling transistor in addition to the light emitting element, the drive transistor and the storage capacitor, in which the sampling transistor is connected to the write control line at a gate thereof, connected to the signal line at one of source/drain, and connected to the gate of the drive transistor at the other of source/drain, and in which the drive transistor is connected to the light emitting element at one of source/drain and connected to the power control line at the other of source/drain.

A display drive method according to another embodiment of the invention includes the steps of performing a threshold correction operation plural times, which allows the storage capacitor to store the threshold voltage of the drive transistor by applying a drive voltage to the drive transistor in a state in which a gate potential of the drive transistor is fixed in a reference potential before giving the signal value to the storage capacitor, and starting the threshold correction operation in a state in which the gate potential is made to be a correction acceleration potential which is higher than the reference potential only at the time of the threshold correction operation of the first half in the threshold correction operations of plural number of times, then, returning the gate potential to the reference potential to be fixed.

As the pixel circuit operation in the organic EL display device is performed in a higher frequency, the threshold correction operation of the drive transistor is performed in a time division manner in some cases. The threshold correction operation is performed in the time division manner, thereby securing time necessary for the threshold correction operation and cancelling variation of the threshold appropriately.

Now, when considering operation in a further higher frequency, it is necessary to speed up the threshold correction operation and to reduce the number of divided corrections accordingly.

In order to speed up the threshold correction operation, it is necessary to allow the voltage between the gate and the source of the drive transistor to converge to the threshold value more rapidly. In the embodiments of the invention, the correction operation is started by setting the gate potential to be rather higher at the first threshold correction operation. That is, a correction acceleration potential which is higher than the reference potential is used. Accordingly, the voltage between the gate and the source of the drive transistor is made to be high and the amount of current flowing in the drive transistor is increased to thereby accelerate the increase the source potential. Then, the gate potential is returned to the reference voltage after that, thereby compressing the voltage between the gate and the source.

According to another embodiment of the invention, when performing the threshold correction in the time division manner, the threshold correction operation is started in a state in which the gate potential is made to be a correction acceleration potential which is higher than the reference potential only at the time of the threshold correction operation of the first half in the threshold correction operations of plural number of times, then, the gate potential is returned to the reference potential to be fixed. Accordingly, the increase of the source potential is accelerated as well as the voltage between the gate and the source is compressed, thereby shortening time until the voltage between the gate and the source becomes the threshold voltage.

That is, it is possible to speed up the threshold correction operation. It is also possible to shorten a period of each threshold correction operation and to reduce the number of divided corrections for responding to a higher frequency in the pixel circuit operation.

DESCRIPTION OF THE PREFERRED EMBODIMENTS

Hereinafter, as a display device according to an embodiment of the invention, an example of a display device using the organic EL element will be explained in the following order.

Figure 1:
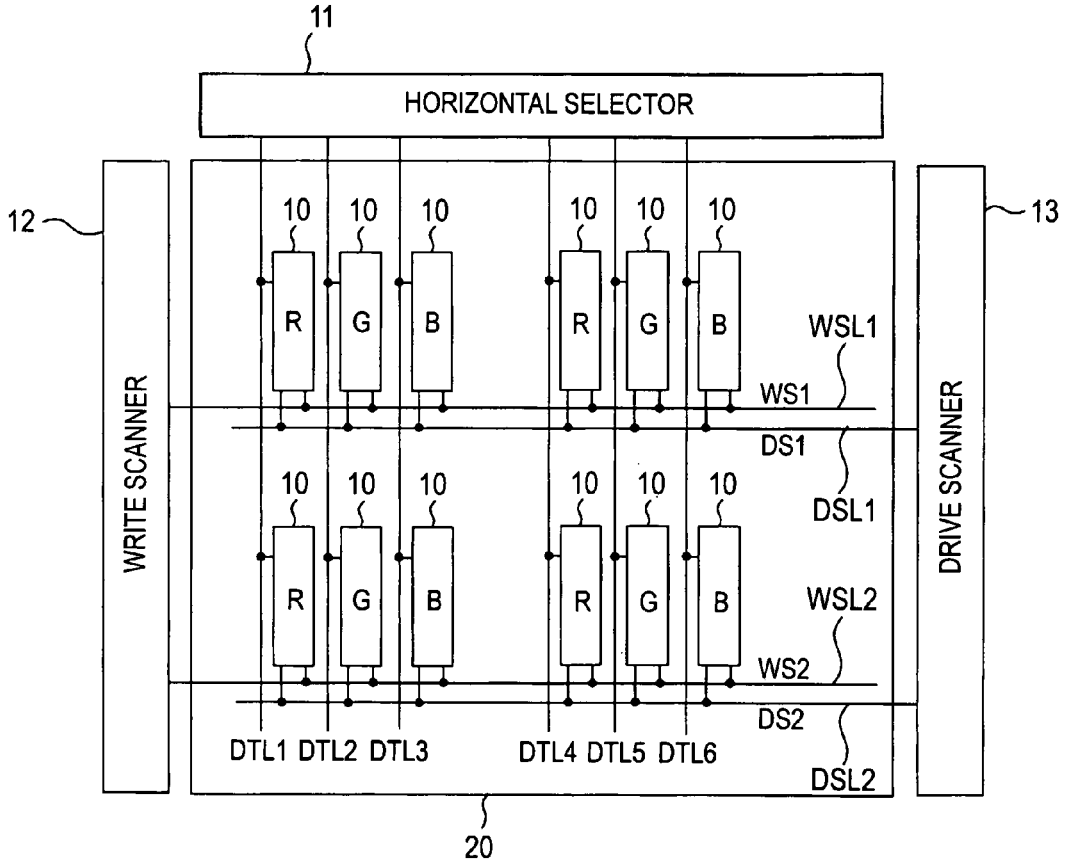
FIG. 1 is an explanatory diagram of a configuration of a display device according to an embodiment of the invention.

1. Configuration of a display device according to an embodiment
2. Pixel circuit operation in a process leading to an embodiment of the invention
3. Pixel circuit operation as an embodiment of the invention 1. Configuration of a Display Device According to an Embodiment FIG. 1 shows the whole configuration of a display device according to an embodiment. The display device includes pixel circuits 10 having a correction function with respect to variation of a threshold voltage and mobility of a drive transistor as described later.

As shown in FIG. 1, the display device of the embodiment includes a pixel array unit 20 in which pixel circuits 10 are arranged in a column direction as well as a row direction in a matrix state. "R", "G" and "B" are given to the pixel circuits 10, which indicate that the circuits are light emitting pixels of respective colors of R (red), G (Green) and B (Blue).

In order to drive respective pixel circuits 10 in the pixel array unit 20, a horizontal selector 11, a write scanner 12 and a drive scanner (drive control scanner) 13 are included.

Additionally, signal lines DTL1, DTL2 . . . which are selected by the horizontal selector 11 and supply video signals corresponding to luminance information as input signals with respect to the pixel circuits 10 are arranged in the column direction in the pixel array unit 20. The signal lines DTL1, DTL2 . . . are arranged by the number of columns of the pixel circuits 10 arranged in the matrix state in the pixel array unit 20.

Furthermore, write control lines WSL1, WSL2 . . . and power control lines DSL1, DLS2 . . . are arranged in the row direction in the pixel array unit 20. These write control lines WSL and the power control lines DSL are arranged by the number of rows of the pixel circuits 10 arranged in the matrix state in the pixel array unit 20.

The write control lines WSL (WSL1, WSL2 . . . ) are driven by the write scanner 12. The write scanner 12 supplies scanning pulses WS (WS1, WS2 . . . ) sequentially to respective write control lines WSL1, WSL2 arranged in rows at set predetermined timings to perform line-sequential scanning of the pixel circuits 10 by the row.

The power control lines DSL (DSL1, DLS2 . . . ) are driven by the drive scanner 13. The drive scanner 13 supplies power pulses DS (DS1, DS2 . . . ) as power supply voltages switched to two values of a drive voltage (V1) and an initial voltage (Vini) to respective power control lines DSL1, DSL2 . . . arranged in rows so as to correspond to the line-sequential scanning by the write scanner 12.

The horizontal selector 11 supplies a signal potential (Vsig) and a reference potential (Vofs) as input signals with respect to the pixel circuits 10 to the signal lines DTL1, DTL2 . . . arranged in the column direction so as to correspond to the line-sequential scanning by the write scanner 12.

Figure 2:
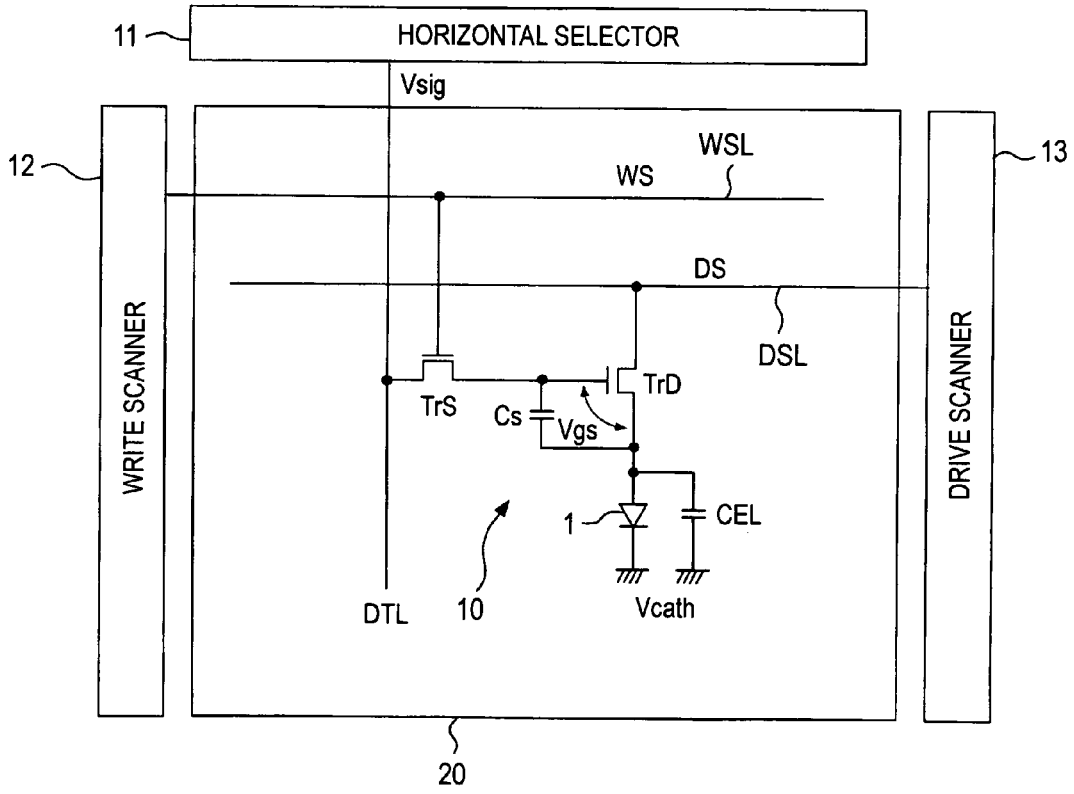
FIG. 2 is an explanatory diagram of a pixel circuit configuration according to the embodiment.

FIG. 2 shows a configuration of the pixel circuit 10. The pixel circuits 10 are arranged in a matrix state as shown in the pixel circuits 10 in the configuration of FIG. 1. In FIG. 2, only one pixel circuit 10 is shown for simplification, which is arranged at a portion where the signal line DTL, the write control line WSL and the power control line DSL cross one another.

The pixel circuit 10 includes an organic EL element 1 as a light emitting element, a storage capacitor Cs and two thin-film transistors (TFT) as a sampling transistor TrS and a drive transistor TrD. The sampling transistor Trs and the drive transistor TrD are n-channel TFTs.

One terminal of the storage capacitor Cs is connected to a source of the drive transistor TrD, and the other terminal is connected to a gate of also the drive transistor TrD.

The light emitting element of the pixel circuit 10 is, for example, an organic EL element 1 of a diode configuration, having an anode and a cathode. The anode of the organic EL element 1 is connected to the source of the drive transistor TrD and the cathode is connected to a given ground wiring (cathode potential Vcath). A capacitor CEL is a parasitic capacitor of the organic EL element 1.

One terminal of drain/source of the sampling transistor TrS is connected to the signal line DTL and the other terminal is connected to the gate of the drive transistor TrD. A gate of the sampling transistor TrS is connected to the write control line WSL.

A drain of the drive transistor TrD is connected to the power control line DSL.

Light emitting drive of the organic EL element 1 is performed in the following manner.

The sampling transistor TrS becomes conductive by the scanning pulse WS given from the write scanner 12 by the write control line WSL at the timing when the signal potential Vsig is applied to the signal line DTL. Accordingly, the input signal Vsig from the signal line DTL is written in the storage capacitor Cs. The drive transistor TrD allows current corresponding to the signal potential stored in the storage capacitor Cs in the organic EL element 1 by current supply from the power control line DSL to which the drive potential V1 is given by the drive scanner 13 to thereby allow the organic EL element 1 to emit light.

In the pixel circuit 10, an operation (hereinafter, referred to as a Vth cancel operation) for correcting effects of variation of a threshold voltage Vth of the drive transistor TrD is performed before current drive of the organic EL element 1. Further, a mobility correction operation for cancelling effects of variation in mobility of the drive transistor TrD is performed simultaneously with the writing of the input signal Vsig from the signal line DTL to the storage capacitor Cs.

2. Pixel Circuit Operation in a Process Leading to an Embodiment of the Invention Here, a circuit operation studied in the process leading to the invention in the above pixel circuit 10 will be explained. Particularly, an operation of performing divided correction as the Vth cancel will be explained with reference to FIG. 3.

Figure 3:
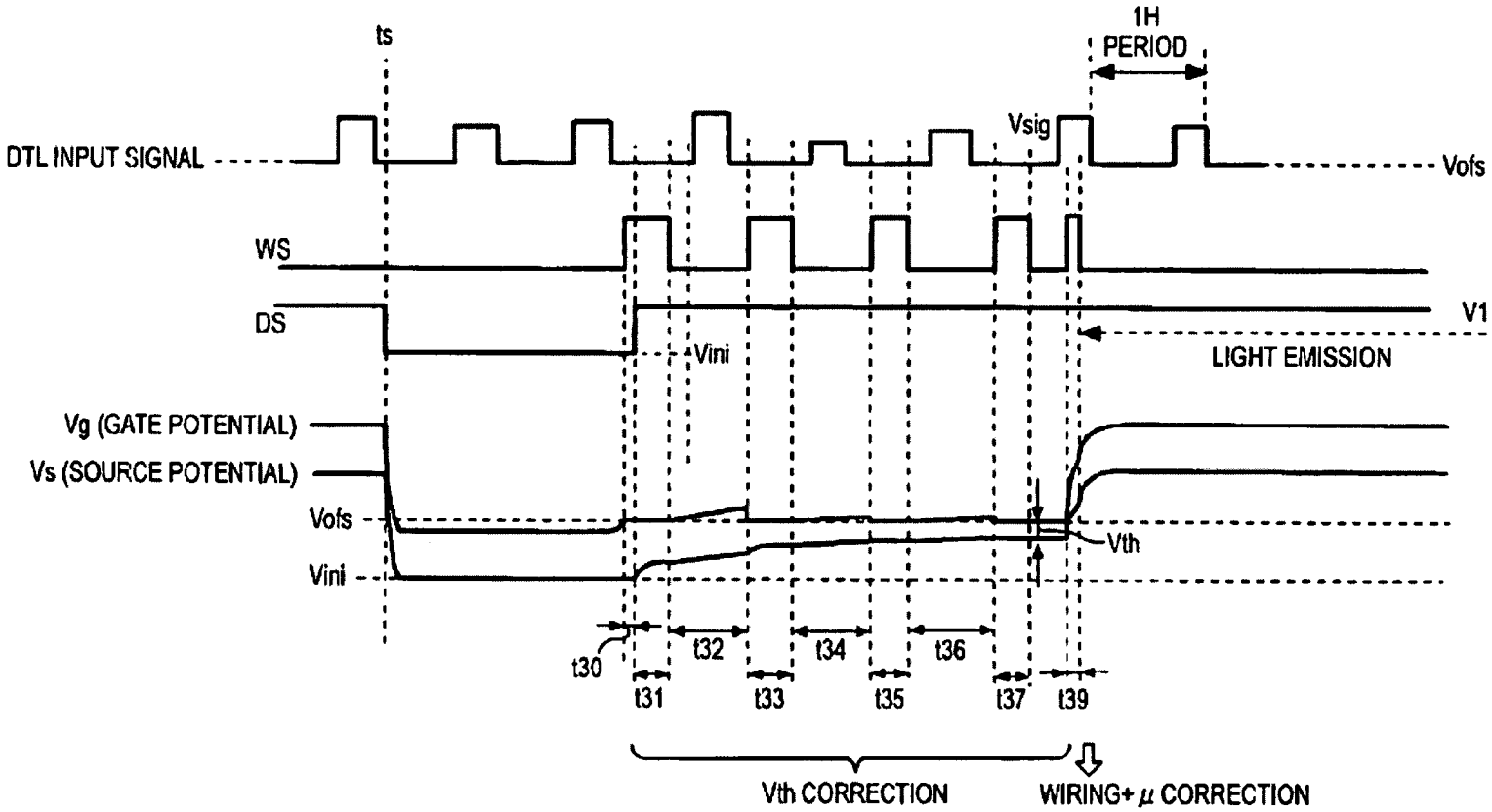
FIG. 3 is an explanatory chart of a pixel circuit operation before reaching the embodiment.

In FIG. 3, the potentials (the signal potential Vsig and the reference potential Vofs) given to the signal line DTL by the horizontal selector 11 are shown as the DTL input signal.

As the scanning pulse WS, a pulse to be applied to the write control line WSL by the write scanner 12 is shown. The sampling transistor TrS is controlled to be conductive/non-conductive by the scanning pulse WS.

As the power pulse DS, voltages to be applied to the power control line DSL by the drive scanner 13 are shown. As the voltages, the drive scanner 13 supplies the drive potential V1 and the initial potential Vini to be switched at predetermined timings.

The variations of a gate potential Vg, a source potential Vs of the drive transistor TrD are also shown.

A point "ts" in a timing chart of FIG. 3 indicates a start timing of one cycle in which the organic EL element 1 as the light emitting element is driven for emitting light, for example, one frame period of image display.

First, the drive scanner 13 supplies the initial potential Vini as the power pulse DS at the point "ts". Accordingly, the source potential Vs of the drive transistor TrD is reduced at the initial potential Vini and the organic EL element 1 is in a non-light emitting state. The gate potential Vg of the drive transistor TrD in a floating state is also reduced.

After that, a preparation for the Vth cancel operation is made during a period t30. That is, when the signal line DTL is in the reference potential Vofs, the scanning pulse WS is made to be H-level to allow the sampling transistor TrS to be conductive. Accordingly, the gate potential Vg of the drive transistor TrD is fixed at the potential Vofs. The source potential Vs maintains the initial potential Vini.

According to the above, a voltage Vgs between the gate and the source of the drive transistor TrD is made to be higher than the threshold voltage Vth to thereby prepare the Vth cancel operation.

Next, the Vth cancel operation is started. In this case, the threshold correction is performed in a time division manner in periods t31, t33, t35 and t37.

First, in the period t31, the power pulse DS is made to be in the drive potential V1 while the gate potential Vg of the drive transistor TrD is fixed in the reference potential Vofs, thereby increasing the source potential Vs.

At this time, the write scanner 12 turns on the scanning pulse WS intermittently in periods when the signal line DTL is in the reference voltage Vofs for preventing the source potential Vs from exceeding the threshold of the organic EL element 1 as well as for allowing the sampling transistor TrS to be non-conductive in periods when the DTL input signal is in the signal potential Vsig. Accordingly, the Vth cancel operation is performed in periods t31, t33, T35 and t37 in the divided manner.

The Vth cancel operation is completed when the voltage Vgs between the gate and the source of the drive transistor TrD is equal to the threshold voltage Vth (period t37).

In a period t32 (after-correction period) after the period t31 when the Vth correction operation is performed, an after-correction period t34 after the period t33 as well as an after-correction period t36 after the period t35, the sampling transistor TrS is in an off state by the scanning pulse WS. This is for preventing signal values from being applied to the gate of the drive transistor TrD during periods in which the DTL input signal is in signal value voltages (signal values for pixels of other lines). However, in the after-correction periods t32, t34 and t36, the drive potential V1 from the power control line DSL is continuously supplied to the drain of the drive transistor TrD.

Since the drive transistor TrD is not completely cut off, electric current is not completely stopped, consequently, a phenomenon in which the source potential Vs is increased and the gate potential Vg is increased accordingly as shown in the drawing. The increased gate potential Vg is returned to the reference potential Vofs as the DTL input signal when the sampling transistor TrS is turned on by the scanning pulse WS.

As described above, after the Vth cancel operation is performed plural times in the divided manner, the scanning pulse WS is turned on at a timing (period t39) when the signal line DTL becomes in the signal potential Vsig with respect to the pixel circuit, thereby writing the signal potential Vsig in the storage capacitor Cs. The period t39 is also a mobility correction period of the drive transistor TrD.

In the period t39, the source potential Vs is increased in accordance with the mobility of the drive transistor TrD. That is, when the mobility of the transistor TrD is high, the increased amount of the source potential Vs is high, and when the mobility is low, the increased amount of the source potential Vs is low. As a result, this will be the operation of adjusting the voltage Vgs between the gate and the source of the drive transistor TrD in the light emitting period in accordance with the mobility.

After that, when the source potential Vs is in the potential exceeding the threshold of the organic EL element 1, the organic EL element 1 emits light.

In short, the drive transistor TrD allows drive current to flow in accordance with the potential stored in the storage capacitor Cs to thereby emit light in the organic EL element 1. At this time, the source potential Vs of the drive transistor TrD is held in a given operation point.

The drive potential V1 is applied to the drain of the drive transistor TrD from the power control line DSL so that the drive transistor TrD is constantly operated in a saturated region, therefore, the drive transistor TrD functions as a constant current source and an electric current Ids flowing in the organic EL element 1 will be represented by the following Formula 1 in accordance with the voltage Vgs between the gate and the source of the drive transistor TrD.

$$I_{ds} = \frac{1}{2}\mu\frac{W}{L}C_{ox}(V_{gs} - V_{th})^2 \quad \text{[Formula 1]}$$

Ids represents the electric current flowing between the drain and the source of the transistor operating in the saturation region, μ represents the mobility, W represents a channel width, L represents a channel length, Cox represents a gate capacity, Vth represents a threshold voltage of the drive transistor TrD and Vgs represents the voltage between the gate and the source of the drive transistor TrD.

Figure 4:
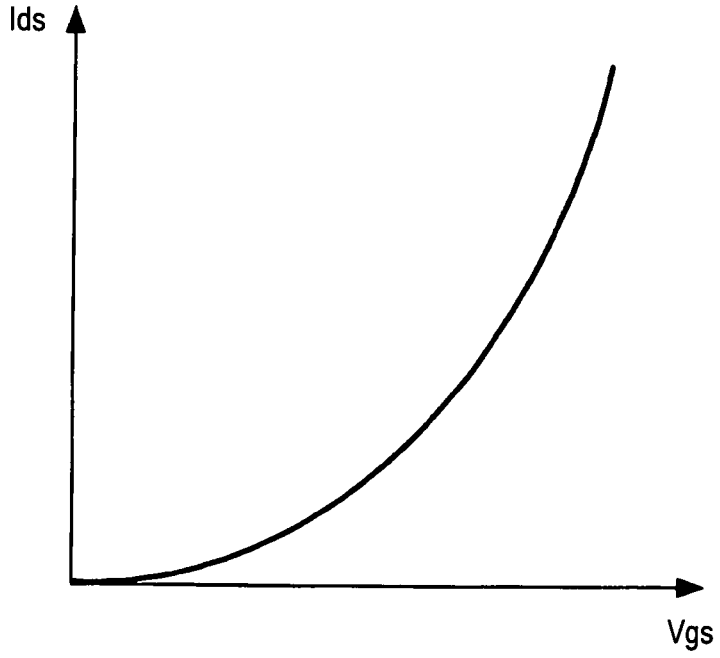
FIG. 4 is an explanatory graph of Ids-Vgs characteristics of a drive transistor.

As can be seen from the Formula 1, the electric current Ids depends on a square value of the voltage Vgs between the gate and the source of the drive transistor TrD, therefore, the relation between the electric current Ids and the voltage Vgs between the gate and the source will be as shown in FIG. 4.

The drain current Ids of the drive transistor TrD is controlled by the voltage Vgs between the gate and the source in the saturation region. Since the voltage Vgs between the gate and the source of the drive transistor TrD (=Vsig+Vth) is fixed by the action of the storage capacitor Cs, therefore, the drive transistor TrD is operated as the constant current source allowing the fixed current to flow in the organic EL element 1.

Accordingly, an anode potential (source potential Vs) of the organic EL element 1 is increased to a voltage at which electric current flows in the organic EL element 1 to allow the organic EL element 1 to emit light. That is, light emission at luminance corresponding to the signal voltage Vsig in this frame is started.

Accordingly, in the pixel circuit 10, the operation for light emission of the organic EL element 1 including the Vth cancel operation and the mobility correction is performed in one frame period.

According to the Vth cancel operation, electric current corresponding to the signal potential Vsig can be given to the organic EL element 1 regardless of variation of the threshold voltage Vth of the drive transistor TrD in each pixel circuit 10 or change of the threshold voltage Vth due to change over time. That is, it is possible to maintain high image quality without generating luminance unevenness and the like on the screen by cancelling the variation of the threshold voltage Vth on manufacture or by the change over time.

Since the drain current changes also by the mobility of the drive transistor TrD, image quality is reduced by variation of the mobility of the drive transistor TrD at each pixel circuit 10, the source potential Vs can be obtained according to the degree of mobility of the drive transistor TrD by the mobility correction, as a result, the source potential Vs is adjusted to obtain the voltage Vgs between the gate and the source which absorbs variation of the mobility of the drive transistor TrD in each pixel circuit 10, therefore, reduction of image quality due to the variation of mobility is also prevented.

3. Pixel Circuit Operation as an Embodiment of the Invention

As described above, as a pixel circuit operation of one cycle, the Vth cancel operation is performed plural times in the divided manner. The reason that the Vth cancel operation is performed plural times in the time division manner is because there is a request for the higher frequency in the display device.

As the frame rate becomes higher, operation time of the pixel circuit becomes relatively shorter, therefore, it is difficult to secure the continuous Vth cancel period. Accordingly, the period necessary for the Vth cancel is secured by performing the Vth cancel operation in the time division manner to thereby allow the voltage between the gate and the source of the drive transistor TrD to converge to the threshold voltage Vth.

However, in order to respond to a further higher frame rate, it is necessary to shorten respective divided correction periods or reduce the number of divided corrections by shortening necessary time as the whole Vth cancel operation.

Accordingly, a method of speeding up the Vth cancel operation and shortening necessary time for the Vth cancel operation will be explained below as a pixel circuit operation according to an embodiment.

Figure 5:
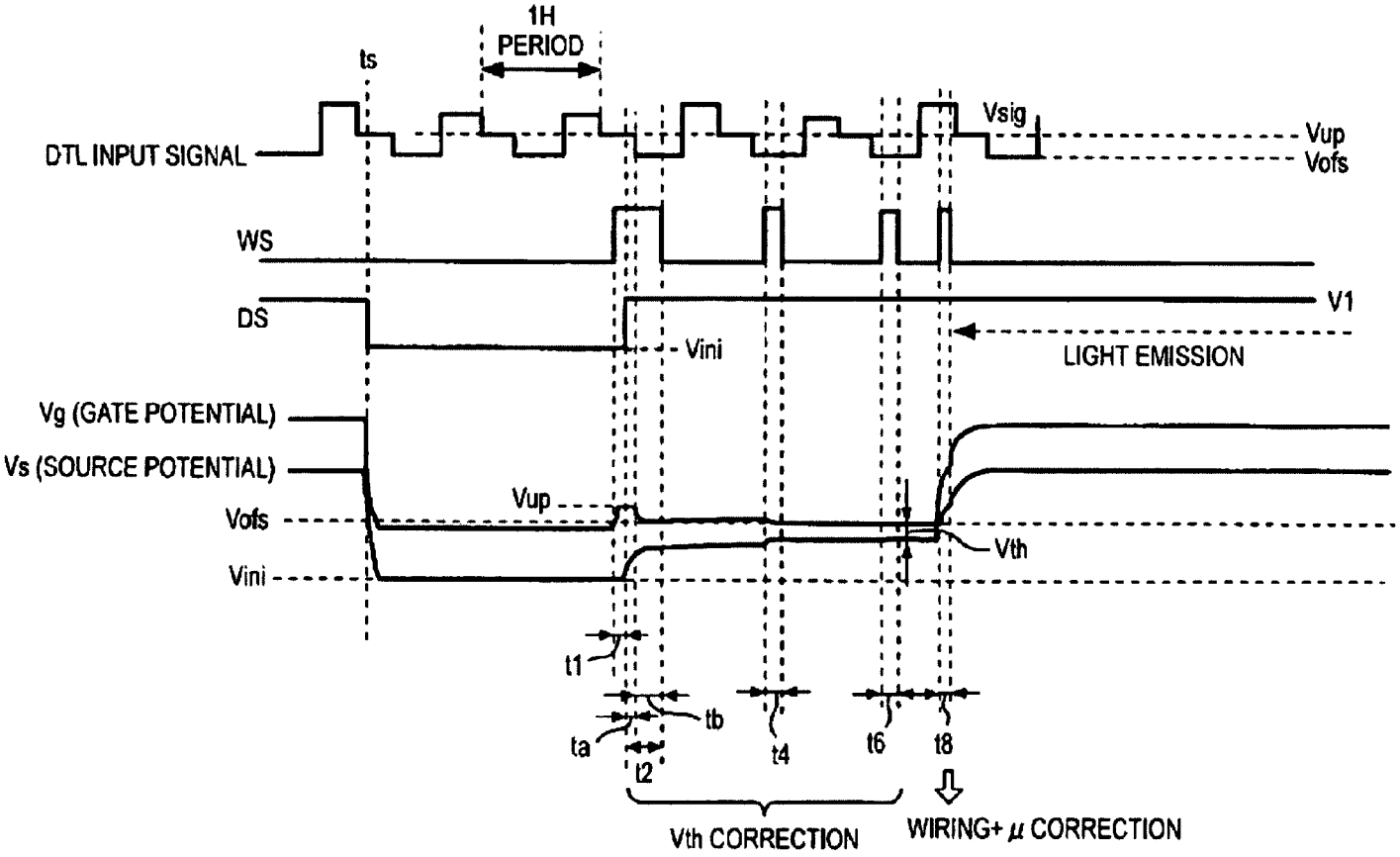
FIG. 5 is an explanatory chart of a pixel circuit operation according to an embodiment.

FIG. 5 shows a circuit operation according to the embodiment.

Also in FIG. 5, potentials given to the signal line DTL by the horizontal selector 11 are shown as the DTL input signal in the same manner as FIG. 3. The horizontal selector 11 gives a correction acceleration potential Vup to the signal line DTL, in addition to the signal potential Vsig and the reference potential Vofs.

That is, as potentials given to the signal line DTL in the 1 H period, the correction acceleration potential Vup is given for a fixed period just after the signal potential Vsig to be given to the pixel, then, the reference potential Vofs is given as shown in the drawing.

Also in FIG. 5, a pulse applied to the write control line WSL by the light scanner 12 as the scanning pulse WS is shown.

As the power pulse DS, voltages to be applied to the power control line DSL by the drive scanner 13 are shown. As potentials to be applied to the power control line DSL, the drive scanner 13 switches the drive voltage V1 and the initial potential Vini at a predetermined timing.

The changes of the gate potential Vg and the source potential Vs of the drive transistor TrD are also shown.

A cycle of the light-emitting drive operation of the organic EL element 1 is started as a point "ts" at a timing chart of FIG. 5.

First, the drive scanner 13 allows the power pulse DS given to the power control line DSL to be the initial potential Vini at the point "ts". According to this, the source potential Vs of the drive transistor TrD is reduced at the initial potential Vini and the organic EL element 1 is in the non-light emitting state. The gate potential Vg of the drive transistor TrD is also reduced.

After that, a preparation for the Vth cancel operation is made during a period t1. That is, the drive scanner 13 allows the scanning pulse WS to be H-level to allow the sampling transistor Trs to be conductive, introducing the potential of the signal line DTL to the gate of the drive transistor TrD.

In the present embodiment, the period t1 corresponds to a period when the signal line DTL is in the correction acceleration potential Vup. Therefore, the gate potential Vg of the drive transistor TrD is equal to the correction acceleration potential Vup.

The source potential maintains the initial potential Vini. As the preparation for the Vth cancel, the voltage Vgs between the gate and the source of the drive transistor TrD is made to be higher than the threshold voltage Vth in this manner.

Next, the Vth cancel operation is started. In this case, the threshold correction is performed in the time division manner in periods t2, t4 and t6.

The period t2 is shown by being divided into periods "ta" and "tb". The period "ta" is a period during which the potential of the DTL input signal is in the correction acceleration potential Vup and the period "tb" is a period during which the DTL input signal is in the reference potential Vofs.

Since the sampling transistor TrS is conductive during the period t2 (periods "ta" and "tb"), the gate potential Vg of the drive transistor TrD is fixed to the potential of the correction acceleration potential Vup in the period "ta" and fixed to the potential of the reference potential Vofs in the period "tb".

The power pulse DS is made to be in the drive potential V1 by the drive scanner 13 during the period t2, thereby increasing the source potential Vs to perform the Vth cancel operation.

Operations in the periods t1, t2 will be described later in detail with reference to FIGS. 6A and 6B.

After that, second and third divided Vth cancel operations are performed in the periods t4 and t6 in the same manner as the operation described in FIG. 3.

That is, in the periods t4 and t6, the power pulse DS is made to be the drive potential V1 by the drive, scanner 13 while the gate potential Vg of the drive transistor TrD is fixed to the reference potential Vofs, thereby increasing the source potential Vs.

The Vth cancel operation is completed when the voltage Vgs between the gate and the source is equal to the threshold voltage Vth (period t6).

As described above, after the Vth cancel operation is performed plural times in the divided manner, the scanning pulse WS is turned on at a timing (period t8) when the signal line DTL becomes in the signal potential Vsig with respect to the pixel circuit, thereby writing the signal potential Vsig in the storage capacitor Cs. The period t8 is also a mobility correction period of the drive transistor TrD.

In the period t8, the source potential Vs is increased in accordance with the mobility of the drive transistor TrD. That is, when the mobility of the transistor TrD is high, the increased amount of the source potential Vs is high, and when the mobility is low, the increased amount of the source potential Vs is low. As a result, this will be the operation of adjusting the voltage Vgs between the gate and the source of the drive transistor TrD in the light emitting period in accordance with the mobility.

After that, when the source potential Vs is in the potential exceeding the threshold of the organic EL element 1, the organic EL element 1 emits light.

In short, the drive transistor TrD allows drive current to flow in accordance with the potential stored in the storage capacitor Cs to thereby emit light in the organic EL element 1. At this time, the source potential Vs of the drive transistor TrD is held in a given operation point.

The drive potential V1 is applied to the drain of the drive transistor TrD from the power control line DSL so that the drive transistor TrD is constantly operated in the saturated region, therefore, the drive transistor TrD functions as a constant current source, and the electric current Ids represented the above Formula 1, namely, the electric current corresponding to the voltage Vgs between the gate and the source of the drive transistor TrD flows in the organic EL element 1. According to this, the organic EL element 1 emits light at luminance corresponding to the signal value Vsig.

Figure 6B:
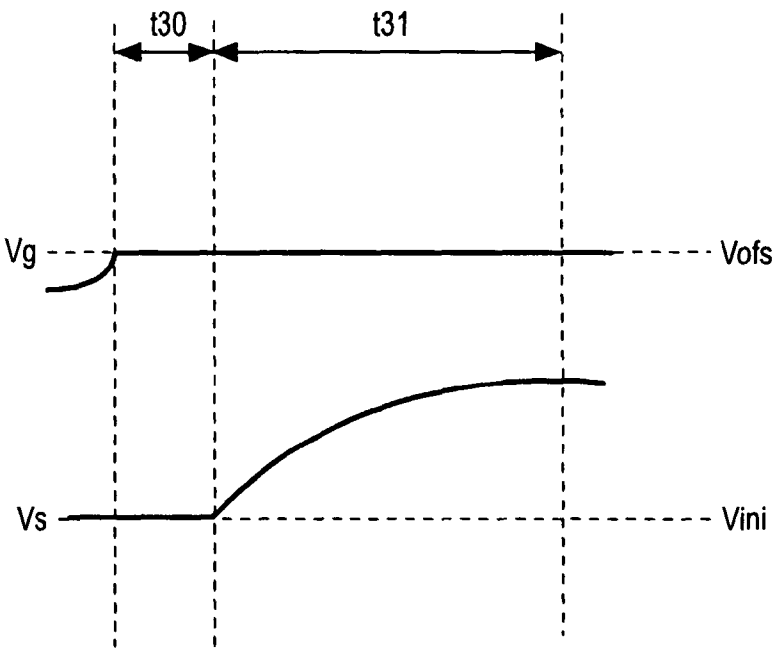
FIG. 6A and FIG. 6B are explanatory charts of a correction acceleration operation according to the embodiment.
Figure 6A:
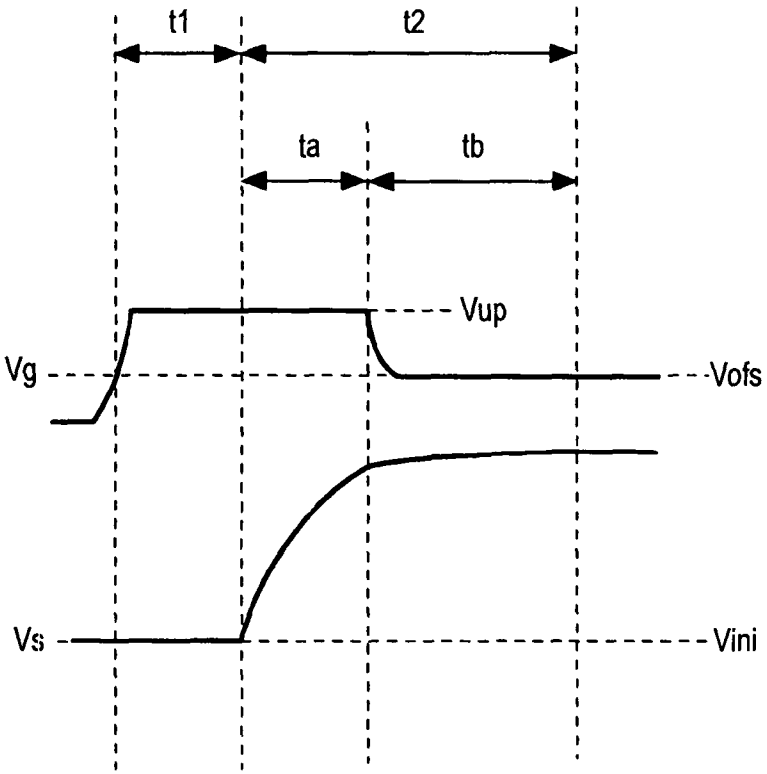

In the above operation of the embodiment, changes of the gate potential Vg and the source potential Vs in the periods t1, t2 (periods "ta" and "tb") are shown in an enlarged manner in FIG. 6A.

The corresponding periods t30, t31 in the above-described operation of FIG. 3 are shown in FIG. 6B for comparison.

In the operation described in FIG. 3, the gate potential Vg is fixed to be equal to the reference potential Vofs as shown in FIG. 6B in the preparation period t30 for the Vth cancel operation. Then, the Vth cancel operation is performed in the period t31 and the source potential Vs is increased, thereby allowing the voltage Vgs between the gate and the source to be close to the threshold voltage Vth.

On the other hand, in the operation of FIG. 5 according to the embodiment, the gate potential Vg is fixed to be equal to the correction acceleration potential Vup in the preparation period t1 for the Vth cancel operation as shown in FIG. 6A.

Since the sampling transistor TrS is conductive during the periods t1, t2, the gate potential Vg changes in accordance with the DTL input signal. That is, when the power pulse DS is made to be the drive potential V1 and the period t2 is started, the gate potential Vg is equal to the correction acceleration potential Vup in the period "ta", and the gate potential Vg is equal to the reference potential Vofs in the period "tb".

Here, since the gate potential Vg is in the correction acceleration potential Vup which is higher than the reference potential Vofs in the period "ta" when the Vth cancel operation is started, the voltage Vgs between the gate and the source is increased as compared with the case of FIG. 6B.

As can be seen from the Formula 1 and FIG. 4, the electric current Ids depends on a square value of the voltage Vgs between the gate and the source. Therefore, in the case of the embodiment, much electric current flows as compared with the operation example of FIG. 3 at the time of starting the Vth cancel operation, which accelerates the increase of the source potential Vs. As can be seen by comparing FIG. 6A with the FIG. 6B, the increase of the source potential Vs is accelerated. This accelerates the operation of drawing the voltage Vgs between the gate and the source to the threshold voltage Vth.

Further, in the case of the embodiment, the gate potential Vg is reduced to the reference potential Vofs in the period "tb". This compresses the voltage Vgs between the gate and the source, which also accelerates the operation of drawing the voltage Vgs between the gate and the source to the threshold voltage Vth.

That is, in the embodiment, the voltage Vgs between the gate and the source is made to be higher than usual at the start point in the first Vth cancel operation in the divided threshold corrections, thereby accelerating the increase of the source potential Vs and accelerating the operation of allowing the voltage Vgs between the gate and the source to be close to the threshold voltage Vth.

Further, the gate potential Vg is returned to the reference potential Vofs after that, also thereby accelerating the operation of allowing the voltage Vgs between the gate and the source to be close to the threshold voltage Vth.

According to the above operation, it is possible to shorten necessary time for the Vth cancel operation.

In the second and third Vth cancel operations in the period t4, t6, the above acceleration is not performed. That is, the scanning pulse WS is turned on only when periods during which the DTL input signal is in the reference voltage Vofs in these periods, thereby preventing the gate potential Vg from rising to the correction acceleration potential Vup.

This is for preventing the voltage Vgs between the gate and the source from being lower than the threshold voltage Vth due to too much effect of acceleration. It is difficult to perform the normal threshold correction when the voltage Vgs between the gate and the source is lower than the threshold voltage, therefore, in the operation example of FIG. 5, the acceleration operation using the correction acceleration potential Vup is performed only in the first Vth cancel operation period t2 in the sense of moderate acceleration.

According to the above operation, in the operation example of the embodiment, it is possible to shorten respective divided periods as the divided Vth cancel operations as well as to shorten the whole Vth cancel operation.

It is possible to perform the threshold correction by three-time divided correction operations in periods t2, t4 and t6 by shortening time due to acceleration of the threshold correction operation as shown, for example, in FIG. 5, which realizes reduction of the number of divided corrections as compared with the four-time divided correction operations shown in FIG. 3.

This shortening of time is also desirable for responding to the higher frame rate.

It is also possible to secure the accuracy in the threshold correction by not performing the acceleration processing every time in the divided correction operations.

The embodiment of the invention has been explained as the above, however, the invention is not limited to the embodiment and various modifications can be considered.

For example, the configuration example including two transistors TrD, TrS and the storage capacitor Cs as shown in FIG. 2 is cited as the pixel circuit 10 in the embodiment, however, the invention can be applied to pixel circuits other than the above, for example, a case of the pixel circuit having a configuration including three or more transistors.

In the example of the embodiment, the acceleration processing is performed only in the first Vth cancel operation t2, however, for example, when performing three-time divided correction operations, an operation example of performing the acceleration operation at the first time and the second time can be considered.

As the matter of course, it can be considered that the acceleration processing is performed only at the first time, or at the first time and the second time, or at the first to the third times in the case of performing divided correction operations, for example, four or more times.

That is, various cases can be considered as cases in which the acceleration processing is performed in the first half and the acceleration processing is not performed in the last half in the divided correction operations of plural number of times.

The acceleration processing is performed for accelerating convergence of the voltage Vgs between the gate and the source to the threshold voltage Vth. At the same time, the voltage Vgs between the gate and the source may possibly be lower than the threshold voltage Vth due to too much acceleration.

To what degree the acceleration processing is desirable to be performed depends on operations by actual circuit design, characteristics of the drive transistor TrD and the like, therefore, it is preferable to determine how to set the correction period in which acceleration is performed in the divided correction operation in accordance with the actual design circuit.

The present application contains subject matter related to that disclosed in Japanese Priority Patent Application JP 2008-210509 filed in the Japan Patent Office on Aug. 19, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device for displaying image frames of a video signal, the display device comprising:

a pixel array including pixel circuits arranged in a matrix state, signal lines, and row scanning lines, in which each of the pixel circuits has at least:

a light emitting element, a drive transistor that has a source electrode connected to the light emitting element, wherein the drive transistor is configured to apply an electric current to the light emitting element, the magnitude of the electric current supplied to the light emitting element depending on a gate-source voltage between a gate electrode of the drive transistor and the source electrode of the drive transistor, a switching transistor having an input terminal connected to one of the signal lines, an output terminal connected to a first node, the first node being connected to the gate electrode of the drive transistor, and a gate electrode connected to one of the row scanning lines, where the switching transistor controls an electrical connection between the one of the signal lines and the first node, and a storage capacitor that has a first terminal connected to the first node and a second terminal connected to the source electrode of the drive transistor; and a driving circuit configured to selectively supply a gradation potential, a reference potential that is different from the gradation potential, and an acceleration potential that is lower than the gradation potential and higher than the reference potential to the input terminal of the switching transistor of a given one of the pixel circuits via the signal lines, selectively supply a drive potential to a drain electrode of the drive transistor of each of the pixel circuits, and selectively supply an ON potential and an OFF potential to the gate electrode of the switching transistor of the given one of the pixel circuits via the row scanning lines, such that:

the acceleration potential is supplied to the one of the signal lines that is connected to the given one of the pixel circuits from at least a first timing until a second timing;

the reference potential is supplied to the one of the signal lines that is connected to the given one of the pixel circuits from at least the second timing until a third timing;

the ON potential is supplied to the one of the row scanning lines that is connected to the given one of the pixel circuits from at least the first timing until the third timing; and the drive potential is supplied to the drain electrode of the drive transistor of the given one of the pixel circuits from at least the first timing until the third timing;

wherein the first timing occurs after the given one of the pixel circuits ends all of a light emission for a given image frame of the image frames, the given image frame not being a final image frame of the image frames, the second timing occurs after the first timing, and the third timing occurs after the second timing and before a fourth timing, the fourth timing being a timing at which the supply to the given one of the pixel circuits of the gradation potential for the given one of the pixel circuits for a next image frame of the image frames begins, the next image frame following immediately after the given image frame.

2. The display device according to claim 1, wherein the driving circuit is configured to perform a threshold correction operation for the given one of the pixel circuits a plurality of times between the first timing and the fourth timing such that by the fourth timing a threshold value of the driving transistor of the given one of the pixel circuits is stored in the storage capacitor of the given one of the pixel circuits, the threshold correction operation comprises supplying the ON potential to the one of the row scanning lines that is connected to the given one of the pixel circuits while the drive potential is supplied to the drain electrode of the drive transistor of the given one of the pixel circuits, and between the third timing and the fourth timing the ON potential is not supplied to the one of the row scanning lines that is connected to the given one of the pixel circuits concurrently with the acceleration potential being supplied to the one of the signal lines that is connected to the given one of the pixel circuits.

3. The display device according to claim 2, wherein the driving circuit further comprises:

a signal selector that selectively supplies the gradation potential, the reference potential and the acceleration potential to the pixel circuits through the signal lines;

a write scanner that selectively supplies the ON potential and the OFF potential to the pixel circuits through the row scanning lines, and a drive control scanner that selectively supplies the drive potential to the drive transistor of each of the pixel circuits through power control lines.

4. The display device according to claim 3, wherein:

the drain electrode of the drive transistor of each of the pixel circuits is connected to a corresponding one of the power control lines.

5. A display drive method of a display device for displaying image frames of a video signal, wherein the display device includes:

a pixel array comprising pixel circuits arranged in a matrix state, signal lines, and row scanning lines, in which each of the pixel circuits has at least:

a light emitting element, a drive transistor that has a source electrode connected to the light emitting element, wherein the drive transistor is configured to apply an electric current to the light emitting element, the magnitude of the electric current supplied to the light emitting element depending on a gate-source voltage between a gate electrode of the drive transistor and the source electrode of the drive transistor, a switching transistor having an input terminal connected to one of the signal lines, an output terminal connected to a first node, the first node being connected to the gate electrode of the drive transistor, and a gate electrode connected to one of the row scanning lines, where the switching transistor controls an electrical connection between the one of the signal lines and the first node, and a storage capacitor that has a first terminal connected to the first node and a second terminal connected to the source electrode of the drive transistor; and a driving circuit configured to selectively supply a gradation potential, a reference potential that is different from the gradation potential, and an acceleration potential that is lower than the gradation potential and higher than the reference potential to the input terminal of the switching transistor of a given one of the pixel circuits via the signal lines, selectively supply a drive potential to a drain electrode of the drive transistor of each of the pixel circuits, and selectively supply an ON potential and an OFF potential to the gate electrode of the switching transistor of the given one of the pixel circuits via the row scanning lines;

the display drive method comprising:

supplying the acceleration potential to the one of the signal lines that is connected to a given one of the pixel circuits from at least a first timing until a second timing;

supplying the reference potential to the one of the signal lines that is connected to the given one of the pixel circuits from at least the second timing until a third timing;

supplying the ON potential to the one of the row scanning lines that is connected to the given one of the pixel circuits from at least the first timing until the third timing;

supplying the drive potential to the drain electrode of the drive transistor of the given one of the pixel circuits from at least the first timing until the third timing;

wherein the first timing occurs after the given one of the pixel circuits ends all of a light emission for a given image frame of the image frames, the given image frame not being a final image frame of the image frames, the second timing occurs after the first timing, and the third timing occurs after the second timing and before a fourth timing, the fourth timing being a timing at which the supply to the given one of the pixel circuits of the gradation potential for the given one of the pixel circuits for a next image frame of the image frames begins, the next image frame following immediately after the given image frame.

6. The display device of claim 1, wherein the driving circuit is further configured to:

supply the acceleration potential to the one of the signal lines that is connected to the given one of the pixel circuits from a fifth timing until the first timing, supply an initialization potential to the drain electrode of the drive transistor of the given one of the pixel circuits from the fifth timing until the first timing, wherein the fifth timing occurs after the given one of the pixel circuits ends all of the light emission for the given image frame and before the first timing.

7. The display drive method of claim 5, further comprising:

performing a threshold correction operation for the given one of the pixel circuits a plurality of times between the first timing and the fourth timing such that by the fourth timing a threshold value of the driving transistor of the given one of the pixel circuits is stored in the storage capacitor of the given one of the pixel circuits, wherein the threshold correction operation comprises supplying the ON potential to the one of the row scanning lines that is connected to the given one of the pixel circuits while the drive potential is supplied to the drain electrode of the drive transistor of the given one of the pixel circuits, and between the third timing and the fourth timing the ON potential is not supplied to the one of the row scanning lines that is connected to the given one of the pixel circuits concurrently with the acceleration potential being supplied to the one of the signal lines that is connected to the given one of the pixel circuits.

8. The display drive method of claim 5 further comprising:

supplying the acceleration potential to the one of the signal lines that is connected to the given one of the pixel circuits from a fifth timing until the first timing, and supplying an initialization potential to the drain electrode of the drive transistor of the given one of the pixel circuits from the fifth timing until the first timing, wherein the fifth timing occurs after the given one of the pixel circuits ends all of the light emission for the given image frame and before the first timing.

9. The display device of claim 6, wherein every instance of the gradation potential that is supplied to the signal lines corresponds to a gradation value for the given one of the pixel circuits for the given image frame, the acceleration potential is a potential different from the reference potential, the ON potential turns on the switching transistor of the given one of the pixel circuits when supplied to the gate electrode of the switching transistor of the given one of the pixel circuits, the OFF potential turns off the switching transistor of the given one of the pixel circuits when supplied to the gate electrode of the switching transistor, the drive potential is supplied to the drain electrode of the drive transistor of the given one of the pixel circuits when the given one of the pixel circuits is driven to emit light, and the initialization potential is such that, when supplied to the drain electrode of the drive transistor of the given one of the pixel circuits, the given one of the pixel circuits cannot emit light.

10. A display device for displaying image frames of a video signal, the display device comprising:

pixel circuits arranged in a matrix form, signal lines, and row scanning lines, each of the pixel circuits including:

a light emitting element, a drive transistor that has a first current electrode connected to the light emitting element, a second current electrode connected to a power supply node, and a gate electrode connected to a first node, a storage capacitor that has a first terminal connected to the first node and a second terminal connected to the second current electrode of the drive transistor, a switching transistor having an input terminal connected to one of the signal lines, an output terminal connected to the first node, and a gate electrode connected to one of the row scanning lines, where the switching transistor controls an electrical connection between the one of the signal lines and the first node, and a driving circuit configured to selectively supply a gradation potential, a reference potential that is different from the gradation potential, and an acceleration potential that is lower than the gradation potential and higher than the reference potential to the signal lines, selectively supply a drive potential to the second current electrode of the drive transistor of a given one of the pixel circuits via the power supply node of the given one of the pixel circuits, and selectively supply an ON potential and an OFF potential to the gate electrode of the switching transistor of the given one of the pixel circuits via the row scanning lines, such that:

the acceleration potential is supplied to the one of the signal lines that is connected to the given one of the pixel circuits from at least a first timing until a second timing;

the switching transistor of the given one of the pixel circuits that is connected to the one of the signal lines is turned on from at least the first timing until a third timing;

the reference potential is supplied to the first node of the given one of the pixel circuits from at least the second timing until the third timing; and the drive potential is supplied to the power supply node of the given one of the pixel circuits from at least the first timing until the third timing;

wherein the first timing occurs after the given one of the pixel circuits ends all of a light emission for a given image frame of the image frames, the given image frame not being a final image frame of the image frames, the second timing occurs after the first timing, and the third timing occurs after the second timing and before a fourth timing, the fourth timing being a timing at which the supply to the given one of the pixel circuits of the gradation potential for the given one of the pixel circuits for a next image frame of the image frames begins, the next image frame following immediately after the given image frame.

* * * * *